United States Patent [19]

Megumi

[11] 3,958,384

[45] May 25, 1976

[54] STRUCTURE ASSEMBLED OF THE UNIT BODIES HAVING STONE-LIKE TYPE SHELLS AND AN INSULATING INSERT

[75] Inventor: Naomitsu Megumi, Funabashi, Japan

[73] Assignees: Naomitsu Megumi, Funabashi; Tokyo Plywood Kabushiki Kaisha, Tokyo, both of Japan

[22] Filed: Apr. 24, 1975

[21] Appl. No.: 571,120

Related U.S. Application Data

[62] Division of Ser. No. 413,052, Nov. 5, 1973, Pat. No. 3,903,668.

[30] Foreign Application Priority Data

Nov. 17, 1972 Japan ..... 47-115432
Dec. 7, 1972 Japan ..... 47-122689

[52] U.S. Cl. ..... 52/477; 52/266; 52/405; 52/587; 52/612

[51] Int. Cl.² ..... E04B 2/88; E04B 2/58; E04B 1/76; E04B 1/04

[58] Field of Search ..... 52/612, 267, 405, 268, 52/406, 269, 727, 503, 600, 504, 601, 587, 434, 606, 485, 486, 489

[56] References Cited

UNITED STATES PATENTS

| | | | |
|---|---|---|---|
| 937,635 | 10/1909 | Nicholls | 52/405 X |
| 1,879,319 | 9/1932 | Kleitz | 52/405 X |
| 2,089,045 | 8/1937 | Venzie | 52/606 X |
| 2,178,097 | 10/1939 | Davison et al. | 52/600 X |
| 2,262,899 | 11/1941 | Mechlin | 52/405 X |
| 2,351,856 | 6/1944 | Henderson | 52/601 X |
| 2,387,431 | 10/1945 | Du Laney | 52/434 |
| 3,319,983 | 5/1967 | Zibell | 52/489 X |
| 3,389,560 | 6/1968 | Zemsky | 52/587 |
| 3,512,327 | 5/1970 | La Padura | 52/612 |
| 3,676,973 | 7/1972 | Kellert | 52/601 X |

FOREIGN PATENTS OR APPLICATIONS

| | | | |
|---|---|---|---|
| 481,597 | 3/1952 | Canada | 52/612 |
| 469,822 | 12/1950 | Canada | 52/600 |

*Primary Examiner*—Ernest R. Purser
*Assistant Examiner*—Leslie Braun
*Attorney, Agent, or Firm*—Frank J. Jordan

[57] ABSTRACT

A structural unit body comprises an outer flange extending outwardly from the edge of a box-like frame plate and an inner flange extending inwardly from the other edge. A stuffed box is secured by anchoring means to the inner flange such stuffed box being made of dampproof material covered with a metal net and stuffed with noncombustible materials of mineral or inorganic fibers. Cement mortar is applied to the frame plate, inner flange and to the metal net of the stuffed box and a circumferential groove is formed between the outer flange and the underside of the cement mortar.

3 Claims, 7 Drawing Figures

STRUCTURE ASSEMBLED OF THE UNIT BODIES HAVING STONE-LIKE TYPE SHELLS AND AN INSULATING INSERT

This is a division of application Ser. No. 413,052 filed Nov. 5, 1973 now U.S. Pat. No. 3,903,668.

BACKGROUND OF THE INVENTION

This invention relates to a structural unit body for covering a structure such as a wall, floor, and the like and to a structure assembled from such unit bodies.

The structural unit body of this invention comprises a flat box made of a moisture-proof-material covered with a metal net, and having a noncombustible material disposed within the box, the latter in turn being anchored to a frame. The whole of the assembly is plastered with mortar except for a certain part of the frame. Also, this invention relates to a structure consisting of an assembly made up of a plurality of such structural bodies. Since the structural unit bodies and the structure are fireproof, resilient, strong, and less subject to the effects of temperature and moisture and have sound insulation properties, they can provide a comfortable dwelling and construction capable of meeting variable environmental conditions.

A description will hereinafter be set forth relative to various embodiments of the invention with reference to the accompanying drawings.

SUMMARY OF THE INVENTION

A construction arrangement for a structure such as a wall or floor includes a plurality of unit bodies each comprising a frame having an outer flange and an inner flange arranged such that the inner flange circumscribes an opening in the frame. A stuffing box in which a noncombustible material is disposed is secured to the frame by anchoring means to thereby close off the aforementioned opening in the frame. Cement mortar is disposed on at least a portion of the stuffing box and the frame and such cement mortar is arranged relative to the outer flange to form a circumferential groove between the cement mortar and the outer flange of the frame. A plurality of the unit bodies are secured to a structure with the circumferential grooves arranged adjacent to one another and interconnecting means are disposed in the circumferential grooves for interconnecting the adjacent unit bodies to one another.

DESCRIPTION OF THE PREFERRED EMBODIMENTS

Figure 1:
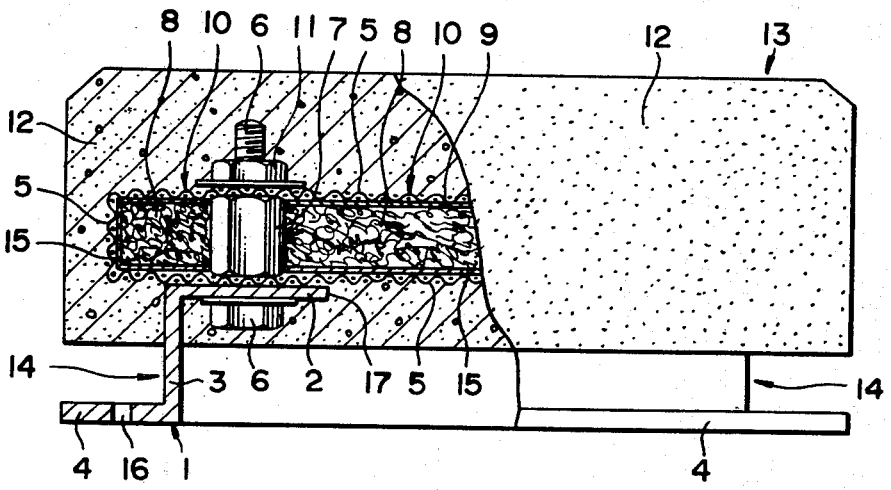
FIG. 1 is an elevational view, broken partly away and in section, of a structural unit body according to one embodiment of the invention.
Figure 2:
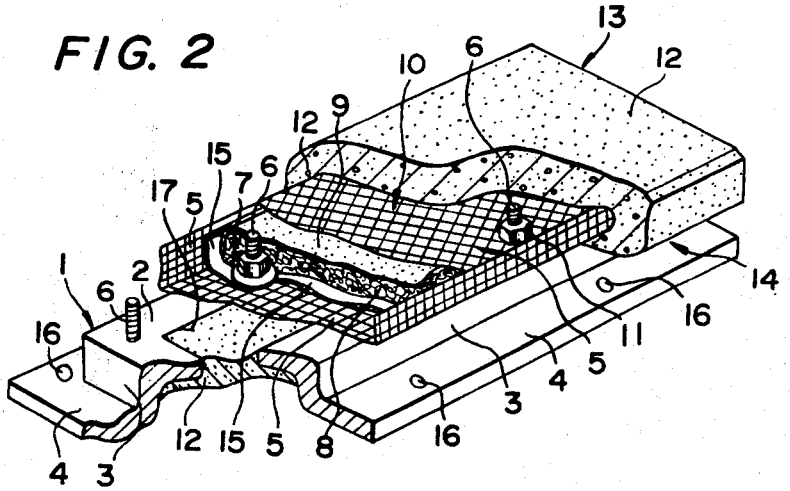
FIG. 2 is a perspective view partly broken away and in section of the structural unit body shown in FIG. 1.
Figure 3:
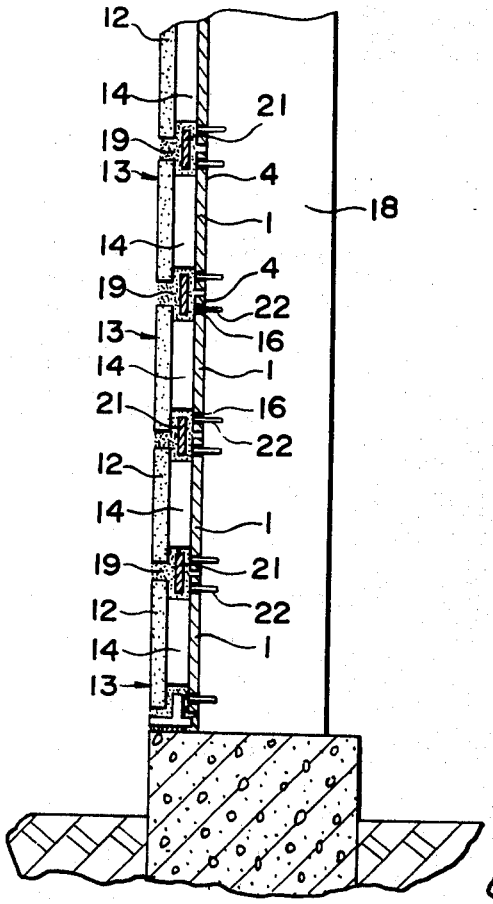
FIG. 3 is a cross sectional view of a structure assembled with the unit bodies shown in FIGS. 1 and 2.

EXAMPLE 1:

A description will first be set forth relating to the structural unit body shown in FIGS. 1 and 2 and the structure assembled from these unit bodies as shown in FIG. 3. In FIGS. 1 and 2, an outwardly facing outer flange 4 on one end edge of a square box-like frame plate 3 made of a metal plate or a noncombustible hard material is constructed in a step-like manner integrally with an inwardly facing inner flange 2 on the other end edge to thereby form a step-like frame 1 having an opening 17 formed on the upper surface flange of the inner flange 2. In this connection, the outer flange 4 extends circumferentially at the bottom and defines a flate base. Also the inner flange 2 has a flat upper surface with an opening 17, and the flange is provided with anchoring means such as bolts 6, nuts 7, or the like. A square flat box 15 is provided and the surfaces thereof have a cover 9 made of moisture-proof paper, hard board or particle board which in turn is covered with a metal net 5. The box is stuffed with a noncombustible material 8 such as inorganic fibers, mineral fibers, nonwoven cloth, felt-like material, and the like to thereby form a stuffed box 10, the box 10 thus finished being secured and tightened by the anchoring means 6, 7 and 11 on the inner flange 2 and the opening 17 is closed. Then cement mortar 12 is applied and hardened in a specified shape to the entire surfaces of the inner flange 2, the anchoring means and the metal net from the upper part of the middle of the frame plate 3 to thereby construct the unit body 13. In the unit body, there is formed a space between the outer flange 4 of the frame plate 3 and the bottom of the cement mortar 12 to thereby form a circumferential groove 14 about the entire circumference, so that a connection plate, as will hereinafter be described in greater detail, can be inserted into the circumferential groove 14. Thus the outer flange 4 becomes a base which can be fixed to a wall or floor by use of fitting holes 16 provided in the flange 4.

In the structural unit body as illustrated, a piece of steel sheet may be punched out to form the frame 1 integrally having the outer flange 4 provided with the fitting holes 16 therein, the flange 2 having the opening 17 therein, and the frame plate 3, wherein the noncombustible material 8, in addition to the materials hereinabove described, may be a lightweight inorganic material such as vermiculite, pearlite, an the like. The metal net 5 may be formed by punching out a metal sheet such as an iron sheet or it may be made woven wire. Because the exposed parts of the metal net 5 and the inner flange are allowed to be used and solidified as steel bars for the cement mortar 12, the mortar 12 is strong.

FIG. 3 shows a structure assembled with the aforestated unit bodies. As shown in passing 3, the unit body is fixed to a structure 18 such as a wall, floor or the like by anchoring means 22 passing through the fitting holes 16 in the outer flange 4 of the frame 1 in the unit body 13. Connecting plates 21 are inserted into the circumferential grooves 14 to thereby connect the structural unit bodies 13 to each other in each direction to thereby extend the assembled unit bodies 13, and thereafter a mortar joint or expansion joint 19 is filled in the spaces between the connected parts and fixed. In this manner, a structure can be assembled as shown in FIG. 3.

Figure 4:
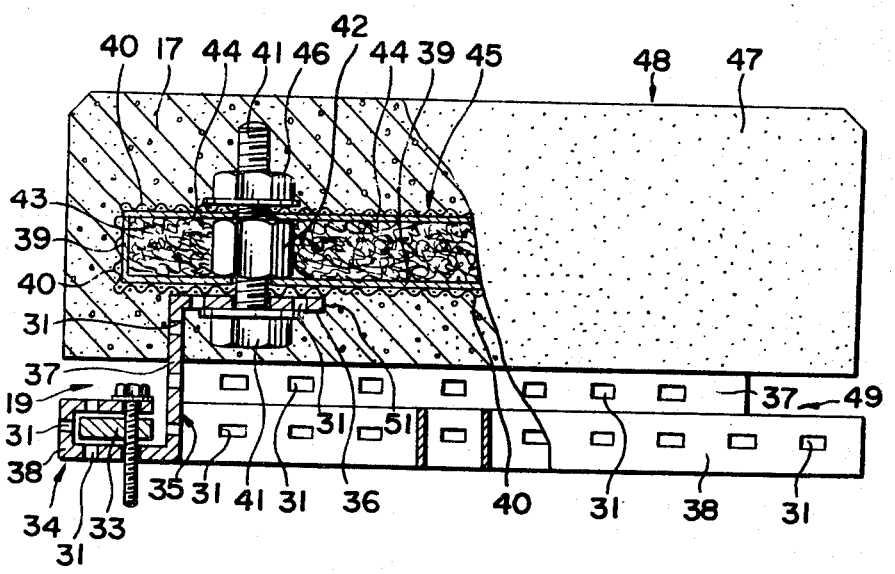
FIG. 4 is an elevational view, partly broken away and in section, of a structural unit body according to another embodiment of the invention.
Figure 5:
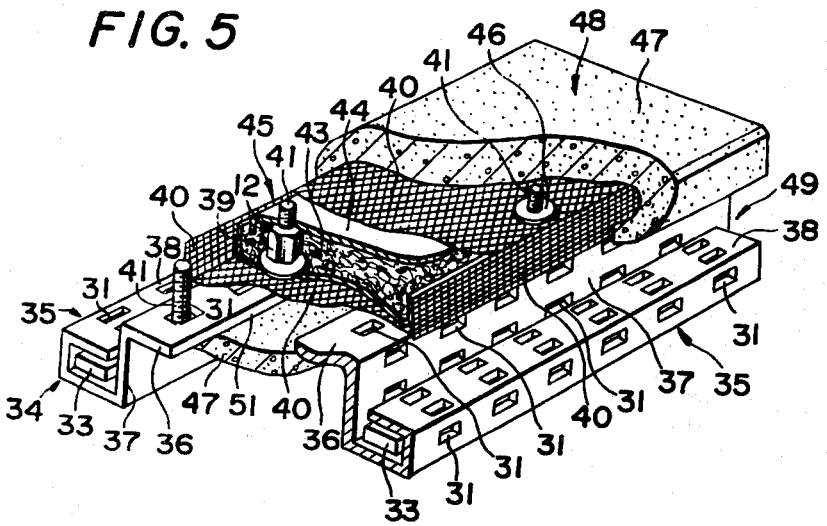
FIG. 5 is a perspective view partly broken away and in section, of the structural unit body shown in FIG. 4.
Figure 6:
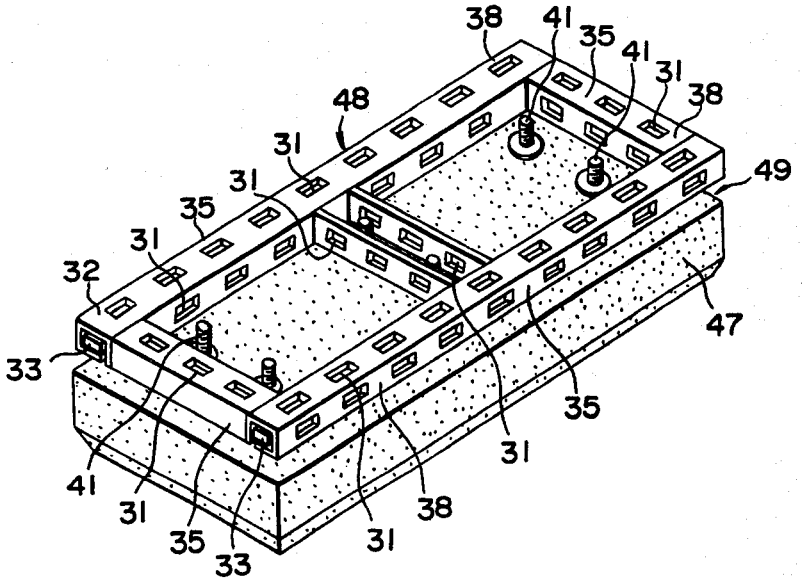
FIG. 6 is a perspective view looking at the back side of the structural unit body shown in FIGS. 4 and 5.

EXAMPLE 2:

A description will now be set forth relating to the structural unit bodies shown in FIGS. 4, 5 and 6 and the structure assembled from these unit bodies.

In FIGS. 4, 5 and 6, one side edge of a metal sheet having numerous holes 31 formed regularly or irregularly is bent in a right-angled L-shape so as to form an inwardly facing inner flange 36, and the other side edge is bent to form a U-shaped box 34 in which there is stuffed a reslient buffer material 33, the arrangement just described thereby forming step-like base 35. The base 35 thus formed, as shown in FIG. 6, is assembled or joined at four corners so as to form a square frame 32 having an inner flange 36, side walls or frame plate 37 and outer flange 38. An opening 51 is formed in the middle of the inner flange 36 at the circumferential edge of the flange 36. Separately, as shown in FIGS. 4 and 5, there is provided a flat box 39 having a cover 44 made of a moisture-proof material such as covered with paper, hard board, particle board or the like and with a metal net 10, such box being stuffed with a noncombustible material 43 such as inorganic fibers, mineral fibers, nonwoven cloth and felt-like material made thereof, and the like. A stuffed box 45 of this same type is fastened to the surface of the inner flange 36 by anchoring means such as bolts 41, nuts 42 and 46 and the like whereby, the opening 51 and the holes 31 in the inner flange 36 are closed. Cement mortar 47 is plastered in a specified shape and fixed to the whole of the surface of the top portion of the side walls 37, inner flange, anchoring means and stuffed box to thereby form a structural unit body 48.

This unit body also is formed with a circumferential groove 49 between the outer flange 38 and the mortar 47.

In the embodiment of FIGS. 4, 5 and 6, the metal sheet having holes 31 is used as a base 35, but atternatively a metal net made of strong and thick wire may be used instead. The quality of the material used in each part is the same as that in Example 1. The buffer material 33 inserted into the box 34 of the base 35 may be a resilient material of antiseptically treated wood, plywood or synthetic resin.

Figure 7:
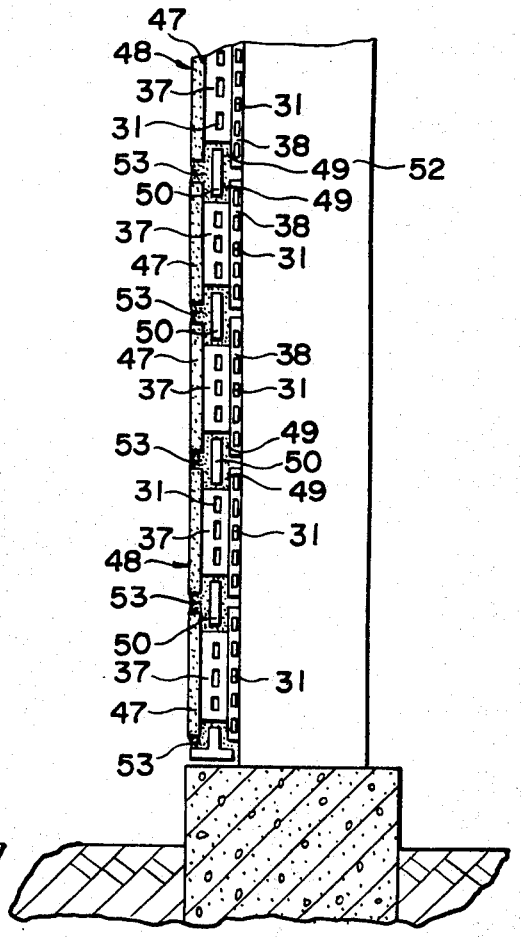
FIG. 7 is a cross sectional view of a structure assembled with the unit bodies shown in FIGS. 4 and 5.

FIG. 7 shows a structure assembled with the aforestated structural unit bodies. As shown in FIG. 7 the outer frame 38 of the structural unit bodies are mounted on a structural body 52 such as a wall, floor, or the like and unit bodies are connected to each other and assembled in various directions by inserting connecting plates 50 into the circumferential grooves 49 of the structural unit bodies 48. The joint 53 is filled and all the members are set and assembled to construct a structure as shown in FIG. 7.

This invention is embodied for industrial applications in the manner described above, and each structural unit body as a whose is highly resistant to impacts from outside so that the step-like frame itself is strong and resilient and also the stuffed box containing noncombustible materials also affords resilience. Even if there are differences in temperature and moisture between the upper surface and the underside of the cemment mortar layer depending upon the climatic conditions, the stuffed box becomes a buffer zone for the temperature difference, so that there is little or no fear of cracks and fissures being produced. For example, when it is rainy or snowy or humid, and even if moisture permeates the inner part of the unit body through the cement mortar layer on the surface of the stuffed box, the moisture is absorbed by the square box enclosing the inorganic fiber materials by atomizing and capillary phenomena due to the action of the air present between the inorganic fibers and the effect of moisture is attenuated by the air around the metal net area. If, in the square box, the nuts 7 and 42 inside of the box are designed or selected with a definite size and thickness, the noncombustible materials inside of the box are not compressed but contain a specified amount of air, and accordingly, the effect described above can always be utilized achieved or to a sufficient extent. The cement mortar applied surface including the circumferential groove is large in area and in surface area of contact with the atmosphere, and hence it has the advantage that the transmission of atomospheric temperature to the structure is reduced to thereby maintain suitable heat retaining properties. Since a structure made up, in suitable combination, of structural unit bodies is connected by connecting plates, the whole of the structure constitutes walls and floors which are resistant to vibration, and hence the structure can resist earthquakes. Furthermore, it acquires desirable properties such as resilience, pliability, fire resistance, shock resistance and the like.

As described above, this invention permits the respective members of a structure to bring their mutual effectivenesses into full play with the state of their functions being maintained and thus provides a comfortable and noncombustible structure that is adaptable to environmental conditions and excellent also in sound and heat insulation properties. Furthermore, the structure is strong and corrosion resistant, and accordingly it can withstand over a long time. Because the structure is prepared as an assembly, it is simple in construction, and affords decorative effects depending upon the style and state in which the unit bodies are arranged, and because it is lighter in weight than the conventional concrete blocks, it is convenient both for transportation and in handling. Because the structure shown in Example 2 is provided in the whole of the frame with holes 31, it provides good adaptability, stability and safety are increased, and moreover it is less influenced by temperatures and humidity. It also provides heat and sound insulation properties on a structure 52, and therefore provides a structure that makes a dwelling comfortable and adapted for variable environmental conditions.

I claim:

1. A construction arrangement for a structure such as a wall or floor comprising a unit body, said unit body including a frame member having four side plates disposed about an opening, each of said side plates having an outer flange means and an inner flange means, said inner flange means circumscribing said opening in said frame, a stuffing box, a noncombustible material within said stuffing box, anchoring means securing said stuffing box to said inner flange means to thereby close said opening, cement mortar disposed on at least portions of said stuffing box and said frame member, said cement mortar being arranged relative to said outer flange means so as to form a circumferential groove between said cement mortar and said outer flange means, said groove providing access to said outer flange means to facilitate affixing the latter to said structure, means securing a plurality of said unit bodies to said structure in an arrangement whereby said plurality of unit bodies are arranged adjacent to one another so that a portion of the circumferential groove of one unit body faces a portion of the circumferential groove of another adjacent unit body, and interconnecting means disposed in said circumferential grooves for interconnecting said adjacent unit bodies to one another.

2. A construction arrangement according to claim 1 wherein said interconnecting means comprises an interconnecting plate, and joining material filling in the space within said circumferential grooves.

3. A construction arrangement according to claim 1 wherein said outer flange means has a U-shape and box-like configuration, and a buffer material disposed in said box-like configuration.

* * * * *

UNITED STATES PATENT AND TRADEMARK OFFICE

CERTIFICATE OF CORRECTION

PATENT NO. : 3,958,384

DATED : May 25, 1976

INVENTOR(S) : Naomitsu MEGUMI

It is certified that error appears in the above-identified patent and that said Letters Patent are hereby corrected as shown below:

Change the title from "STRUCTURE ASSEMBLED OF THE UNIT BODIES HAVING STONE-LIKE TYPE SHELLS AND AN INSULATING INSERT" to -- STRUCTURAL UNIT BODY AND A STRUCTURE ASSEMBLED OF THE UNIT BODIES --

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*